US007018071B1

(12) United States Patent
Belousova et al.

(10) Patent No.: US 7,018,071 B1
(45) Date of Patent: Mar. 28, 2006

(54) LIGHT APPARATUS

(76) Inventors: Lyudmila Belousova, 9921 Bustleton Ave. R-9, Philadelphia, PA (US) 19115; Julia Viseysky, 186 Larkspur St., Philadelphia, PA (US) 19116

( * ) Notice: Subject to any disclaimer, the term of this patent is extended or adjusted under 35 U.S.C. 154(b) by 0 days.

(21) Appl. No.: 10/946,825

(22) Filed: Sep. 23, 2004

(51) Int. Cl.
*F21V 21/30* (2006.01)

(52) U.S. Cl. ..... 362/282; 362/284; 362/322; 362/324; 310/73; 359/233

(58) Field of Classification Search ..... 362/282, 362/283, 284, 280, 322, 323, 324; 40/493; 310/73, 80; 359/233; 446/242
See application file for complete search history.

(56) References Cited

U.S. PATENT DOCUMENTS 4,945,459 A * 7/1990 Ferren et al. ..... 362/284
5,198,939 A * 3/1993 Hewett ..... 359/889
5,408,389 A * 4/1995 Burlingame ..... 362/35
5,517,388 A * 5/1996 Hutchisson ..... 362/35
5,739,604 A * 4/1998 Summerland ..... 310/73
6,663,461 B1 * 12/2003 Fong ..... 446/236

* cited by examiner

*Primary Examiner*—Thomas M. Sember

(57) ABSTRACT

A light apparatus, which produces a central motionless light beam and at least one light beam rotating around the central beam, includes a cylindrical housing, a parabolic reflector, a lamp having a light sours in reflector's focus and a rotating non-transparent disk having a central round opening and at least one non-central opening. The disk is placed in front of the lamp with the reflector.

The disk rotates without use of an electromotor. For rotation, the disk is mounted in an inner mobile metallic, for example aluminum, ring of ball-bearing, wherein balls, separators and an outer fixed ring are electric insulators. The diameter of the disk is preferably close to the diameter of the inner ring and to the diameter of the reflector.

The inner ring is rotated by a rotating magnetic field. The disk rotates together with the inner ring. The rotating magnetic field is created by an inductor-stator, when the inductor-stator is supplied by polyphase alternating electric current.

12 Claims, 1 Drawing Sheet

LIGHT APPARATUS

BACKGROUND OF THE INVENTION

The present invention relates to a lighting engineering and, particularly, to a light apparatus with a mechanical break off light, and even more particularly to a light apparatus with light beams rotating around a central motionless light beam.

The invention also relates to an apparatus with a mechanical break off light by the way of rotation of a disk or an optical element.

It is known a transport signal light apparatus producing a light beam, which rotates in a horizontal plane. The apparatus includes a parabolic reflector, which rotates around a small lamp, and a reflector rotation drive is an electromotor.

In theatrical illumination, it is known a light apparatus, which includes a disk with a number of openings for mounting of stencils for light, wherein the disk is rotatable to insert a selected stencil into the focal plane of a beam of light.

It is known to use rotating spatial light beams that are produced by a complicated laser device. The laser effects systems use extremely powerful lasers, and laser radiation can be dangerous for observers.

It is known a light apparatus which typically includes a housing, a parabolic reflector and a lamp having a light source in reflector's focus. The apparatus produces a central motionless light beam having an optical axis, which coincides with an optical axis of the reflector.

It is also known a device with rotating non-transparent disk having openings for break off light that falls on the disk. The device produces light beams that rotate around disk's axis. In the device, the disk usually is mounted on a shaft, which is rotated by an electromotor.

If a rotating non-transparent disk, which has a central round opening and other openings, is placed within a housing of a light apparatus in front of a lamp with a parabolic reflector perpendicularly to optical axis of the reflector, so that, the center of the central round opening in the disk lies on an optical axis of the reflector, then, when the disk rotates, the apparatus produces a central light beam, which does not rotate, and light beams rotating around the central beam. However, there is a problem to provide rotation of the disk, because the disk with a central round opening can not be mounted on a shaft which is rotated by an electromotor.

In spite of the problem, there is a need to provide a light apparatus which produces a central motionless light beam and light beams rotating around the central beam.

BRIEF SUMMARY OF THE INVENTION

An object of the present invention is a light apparatus, which produces a central motionless light beam and at least one light beam rotating around the central light beam.

In order to achieve the above object, a light apparatus includes a housing, a lamp with a reflector, a rotating disk, a ball-bearing and an inductor-stator.

The rotating non-transparent disk having a central round opening and at least one non-central opening is placed within the housing in front of the lamp with the reflector. The reflector is preferably a parabolic reflector. The disk is placed perpendicularly to optical axis of the reflector, so that, the center of the central round opening in the disk lies on optical axis of the reflector. When the disk rotates, at least one non-central opening produces at least one light beam rotating around the central motionless light beam which is produced by the central round opening.

The ball-bearing having an inner mobile metallic, for example aluminum, ring and having balls, separators and an outer fixed ring of electroinsulating material or materials is placed within the housing. The disk is mounted in the inner ring, which is rotated by a rotating magnetic field. The disk rotates together with the inner ring.

The rotating magnetic field is created by the inductor-stator which is supplied by polyphase alternating current. The inductor-stator is placed between the outer ring of the ball-bearing and the housing. The outer ring is mounted to the inductor-stator, whose base is mounted to the housing. The housing is preferably a cylindrical housing.

In one embodiment of the invention, the inductor-stator comprises an even number of identical coils that are supplied by a polyphase alternating current, and, wherein the coils are placed regularly along a circumference of the outer ring, so that, the axis of each coil is directed along a radius to the center of the circumference, and the coils are mounted on teeth protruding from the base of the inductor-stator.

In another embodiment of the invention, a number of the coils, that are supplied by polyphase alternating current, changes in order to change the speed of rotation of the inner ring of the ball-bearing, together with the disk and the rotating light beam.

In yet another embodiment of the invention, the light apparatus includes a protective glass on the front part of the housing, and the protective glass is mounted to the housing.

In yet another embodiment of the invention, the light apparatus, instead of the ball-bearing, includes a slip-bearing having an inner mobile metallic ring, an outer fixed ring of electric insulator, and a lubricant between these rings, and the disk is mounted in the inner ring of the sleep-bearing, and the disk rotates together with the inner ring, and, wherein the inner ring is rotated by a rotating magnetic field.

In yet another embodiment of the invention, a front part of the light apparatus is separated from its rear (rest) part, and the front part and the rear part are two separate apparatus, wherein the first apparatus includes the front part of the housing, the disk, the ball-bearing and the inductor-stator, and the second apparatus includes the rear part of the housing and a lamp with a reflector.

The present invention has the following advantages:

1. The present light apparatus produces simultaneously the central light beam, which does not rotate, and at least one light beam, which rotates around the central beam.

2. In the present invention, a rotating non-transparent disk, having the central round opening and at least one non-central opening, is located within the housing, and the disk is rotated without use of an electromotor. For rotation, the disk is mounted in an inner mobile metallic ring of a ball-bearing, wherein balls, separators and an outer fixed ring are electric insulators. The disk rotates together with the inner ring which is rotated by the way of electromagnetic induction.

3. The present light apparatus can be easy transformed into a typical light apparatus, which produces only the central motionless beam. For this purpose, for example, in the present light apparatus, the inductor-stator is not supplied by current, and the disk is taken out.

The present light apparatus can be used in the following applications:

- as a light apparatus for an indication of a dangerous zone or an obstacle;
- as a light apparatus for creating of a decorative dynamic light effects;

as a transport signal apparatus;

as a signal light apparatus with a light beam rotating around a central "support" light beam; and as an underwater signal light apparatus, wherein junctions of the housing with a protective glass and an electrical feeding cable are waterproof

DETAILED DESCRIPTION OF THE INVENTION

Figure 1:
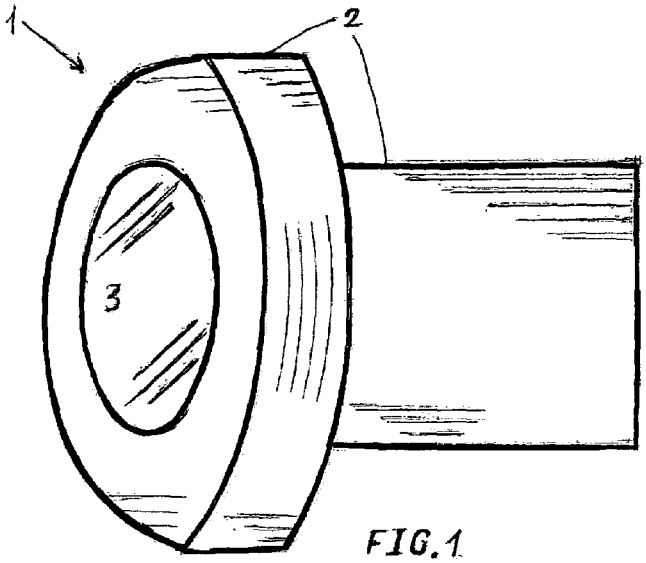
FIG. 1 is a general view of a light apparatus producing a central motionless light beam and at least one light beam rotating around the central beam in accordance with the present invention.
Figure 2:
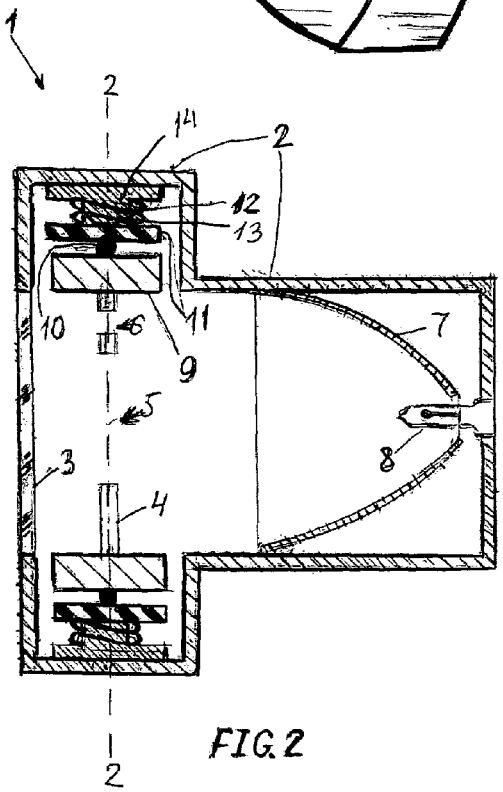
FIG. 2 is a side sectional view of the apparatus shown in FIG. 1.
Figure 3:
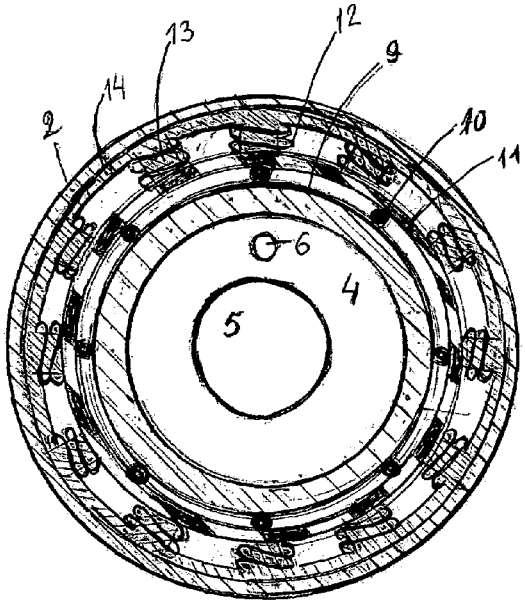
FIG. 3 is a cross-sectional view of the apparatus taken along line 2—2 shown in FIG. 2.

A preferred embodiment of a light apparatus producing a central motionless light beam and at least one light beam rotating around the central beam in accordance with the present invention is illustrated in FIG. 1–FIG. 3.

Referring to FIG. 1, the light apparatus includes a cylindrical housing 2 and a protective glass 3, which is mounted to the housing 2. The glass 3 can be demountable.

According to FIG. 1 and FIG. 3, the housing 2 comprises a rotating non-transparent disk 4 having a central round opening 5 and having at least one non-central, for example round, opening 6. The disk 4 is placed perpendicularly to optical axis of a parabolic reflector 7, so that, the center of the opening 5 lies on optical axis of the reflector 7. A lamp 8, for example a small tungsten halogen lamp, has a compact light source in focus of the reflector 7. The diameter of the reflector 7 is preferably close to the diameter of the disk 4. The outline of the opening 5 does not cross a luminous flux from the reflector 7, when the disk 4 rotates. The outline of the opening 6 crosses the flux, when the disk 4 rotates.

The disk 4 rotates without the use of an electromotor. For rotation, the disk 4 is mounted in an inner mobile metallic, for example aluminum, ring 9 of a ball-bearing with balls 10, with separators (not shown) and with an outer fixed ring 11. Balls 10, separators and the ring 11 are electric insulators. Balls 10, and separators are preferably small, and the ring 11 is preferably thin. The diameter of the ring 9 is preferably close to the diameter of the disk 4. The axis of rotation of the ring 9 coincides with optical axis of the reflector 7.

The ring 9 is rotated by a rotating magnetic field which is created by an inductor-stator. The inductor-stator is supplied by polyphase alternating current and is placed between the ring 11 and the housing 2. The disk 4 rotates together with the ring 9.

In order to prevent creation of induction current in balls 10, in separators and in the ring 11 by the rotating magnetic field, they must be made of electro-insulating material or materials, for example, of plastic, ceramic, wood or glass. In such case, the rotating magnetic field does not influence on balls 10, separators and the ring 11. The disk 4 can be metallic or non-metallic.

A small diameter of balls 10, a small size of separators, and a small thickness of the ring 11 are preferred to keep the distance between the inductor-stator and the ring 9 to a minimum.

According to FIGS. 2 and 3, the inductor-stator includes identical coils 12 that are regularly placed along a circumference of the outer ring 11 and the axis of each coil directs along a radius to the center of circumference. A number of coils 12 must be equal to an even number. In FIG. 2 and FIG. 3 is shown the case, when the number of coils 12 equals to twelve. Coils 12 are mounted on teeth 13 that protrude from a base 14 of the inductor-stator. The base 14 is mounted to the housing 2. The outer ring 11 is mounted to the inductor-stator and, particularly, to the ends of teeth 13.

The base 14 and teeth 13 must be made of a metal such as iron.

The light apparatus works, so that, when coils 12 are supplied by polyphase alternating current, the rotating magnetic field arises and makes the induction current into the metallic ring 9. As a result of the interaction between the magnetic field of induction current into the ring 9 and the rotating magnetic field, the ring 9 rotates. The disk 4 having the central round opening 5 and one non-central round opening 6 rotates together with the ring 9. Then, the opening 6 produces a rotating light beam. The opening 5 produces a central motionless light beam, when the disk 4 rotates or does not rotate.

The ring 9, the disk 4 and the rotating light beam rotate simultaneously, and the direction of their rotation coincides with the direction of rotation of the rotating magnetic field which produces the rotation of the ring 9. The time of one revolution of the ring 9, of the disk 4 and of the rotating light beam always is more than time of one revolution of the rotating magnetic field. The time of one revolution of the field, as known, is proportional to a number of coils of inductor-stator and is inversely proportional to the frequency of current in the coils. From here, in case twelve coils 12 (see FIG. 2 and FIG. 3) for 60 Hz frequency of the current, the time of one revolution of the field equals to 0.1 sec. Then, the time of one revolution of the rotating light beam is more than 0.1 sec.

Time equal to 0.1 sec is close to time of inertia of eyesight, i.e. time of survive of vision perception in eye. Consequently, an observer sees a separate rotating light beam, when the time of one revolution of rotating beam is more than 0.1 sec.

What is claimed is:

1. A light apparatus producing a central motionless light beam and at least one beam rotating around the central beam, comprising:

a housing;

a lamp with a reflector;

a rotating non-transparent disk having a central round opening and having at least one non-central opening, and said disk is placed within said housing, in front of said lamp with reflector, and said disk is placed perpendicularly to optical axis of said reflector so, that the center of said central round opening in said disk lies on optical axis of said reflector, and, when said disk rotates, at least one said non-central opening produces at least one light beam rotating around central motionless beam which is produced by said central round opening;

a ball-bearing having an inner mobile metallic ring and having balls, separators and an outer fixed ring of electro-insulating material or materials, and said ball-bearing is placed within said housing, and said disk is mounted in said inner ring, and said disk rotates together with said inner ring which is rotated by a rotating magnetic field; and an inductor-stator for creation of said rotating magnetic field, and said inductor-stator is supplied by polyphase alternating current, and said-inductor-stator is placed between said outer ring of said ball-bearing and said housing, and said outer ring is mounted to said inductor-stator, whose base is mounted to said housing.

2. Apparatus as in claim 1, wherein said reflector is a parabolic reflector, and said lamp has a light source in focus of said reflector.

3. Apparatus as in claim 1, wherein said housing is a cylindrical housing.

4. Apparatus as in claim 3, wherein said inductor-stator includes an even number of identical coils that are supplied by polyphase alternating current, and, said coils are placed regularly along a circumference of said outer ring of said ball-bearing so that the axis of each coil is directed along a radius to the center of said circumference, and said coils are mounted on teeth protruding from said base of said inductor-stator.

5. Apparatus as in claim 4, wherein a number of said coils, that are supplied by said polyphase alternating current, changes for a variation of speed of rotation of said inner ring along with said disk and said rotating light beam.

6. Apparatus as in claim 4, wherein a frequency of said polyphase alternating current in said coils changes for a variation of speed of rotation of said inner ring together with said disk and rotating light beam.

7. Apparatus as in claim 4, wherein said base and said teeth of said inductor-stator are made from iron.

8. Apparatus as in claim 3, further comprises a protective glass in front part of said housing, and said protective glass is mounted to said housing.

9. Apparatus as in claim 3, wherein the front part of said apparatus is separated from its rear(rest) part, and said front part and said rear part are two separate apparatus, wherein the first apparatus includes the front part of said housing, said disk, said ball-bearing and said inductor-stator, and the second apparatus includes the rear part of said housing and said lamp with said reflector.

10. Apparatus as in claim 1, wherein said central round opening in said disk and/or at least one said non-central opening in said disk are covered by at least one color filter.

11. Apparatus as in claim 1, wherein said disk has not said central round opening, and said apparatus does not produce said central light beam, and said apparatus produces at least one light beam which rotates around optical axis of said reflector.

12. Apparatus as in claim 1, wherein, instead of said ball-bearing, a slip-bearing with an inner mobile metallic ring, with an outer fixed ring of electric insulator and with a lubricant between these rings includes, and said disk is mounted in said inner ring of said slip-bearing, and said disk rotates together with said inner ring, which is rotated by said rotating magnetic field.

* * * * *